US005956904A

United States Patent [19]

Gentry

[11] Patent Number: 5,956,904

[45] Date of Patent: Sep. 28, 1999

[54] GUTTER DEBRIS SHIELD

[76] Inventor: David L. Gentry, 18556 S.W. Hart Rd., Beaverton, Oreg. 97007

[21] Appl. No.: 09/137,557

[22] Filed: Aug. 20, 1998

[51] Int. Cl.[6] ..... E04D 13/076

[52] U.S. Cl. ..... 52/12; 52/11; 210/474

[58] Field of Search ..... 52/12, 11; 210/474

[56] References Cited

U.S. PATENT DOCUMENTS

| | | | |
|---|---|---|---|
| 546,042 | 9/1895 | Van Horn . | |
| 846,238 | 3/1907 | O'Dowd . | |
| 1,308,311 | 7/1919 | Ward . | |
| 2,072,415 | 3/1937 | Abbitt . | |
| 2,271,081 | 1/1942 | Layton . | |
| 2,284,440 | 5/1942 | Morrissey . | |
| 2,674,961 | 4/1954 | Lake . | |
| 2,841,100 | 7/1958 | Moller . | |
| 3,047,994 | 8/1962 | Brun . | |
| 3,053,393 | 9/1962 | McLean . | |
| 3,295,264 | 1/1967 | Olson . | |
| 3,351,206 | 11/1967 | Wennerstrom . | |
| 3,420,378 | 1/1969 | Turner . | |
| 3,436,878 | 4/1969 | Singer . | |
| 4,032,456 | 6/1977 | Berce . | |
| 4,307,976 | 12/1981 | Butler . | |
| 4,351,134 | 9/1982 | Clarkson . | |
| 4,404,775 | 9/1983 | Demartini . | |
| 4,467,570 | 8/1984 | Kriegel . | |
| 4,644,704 | 2/1987 | Pedgonay . | |
| 4,646,488 | 3/1987 | Burns . | |
| 4,745,710 | 5/1988 | Davis . | |
| 4,769,957 | 9/1988 | Knowles . | |
| 4,866,890 | 9/1989 | Otto . | |
| 4,907,381 | 3/1990 | Ealer | 52/12 |
| 4,959,932 | 10/1990 | Pfeifer . | |
| 5,010,696 | 4/1991 | Knittel . | |
| 5,056,276 | 10/1991 | Nielsen et al. . | |
| 5,072,551 | 12/1991 | Manoogian, Jr. . | |
| 5,092,086 | 3/1992 | Rognsvoog, Sr. . | |
| 5,095,666 | 3/1992 | Williams, Jr. . | |
| 5,109,640 | 5/1992 | Creson . | |
| 5,257,482 | 11/1993 | Sichel . | |
| 5,271,192 | 12/1993 | Nothum, Sr. et al. | 52/12 |
| 5,388,377 | 2/1995 | Faulkner | 52/12 |
| 5,406,754 | 4/1995 | Cosby | 52/12 |
| 5,438,803 | 8/1995 | Blizard, Jr. | 52/12 |
| 5,619,825 | 4/1997 | Leroney et al. | 52/12 |
| 5,623,787 | 4/1997 | Ali | 52/12 |
| 5,729,931 | 3/1998 | Wade | 52/12 |

*Primary Examiner*—Christopher T. Kent
*Assistant Examiner*—Yvonne Horton-Richardson
*Attorney, Agent, or Firm*—Kolisch, Hartwell, Dickinson, McCormack & Heuser

[57] ABSTRACT

An improved gutter screen which includes a first screen having mesh openings, top and bottom surfaces, and first and second opposing edges. A second screen having top and bottom surfaces is positioned adjacent the first screen so that a top surface of a second screen faces the bottom surface of the first screen. The second screen also has mesh openings, and first and second opposing edges, with the first opposing edge of the second screen being fastened to the first opposing edge of the first screen to form a first edge portion and the second opposing edge of the second screen being fastened to the second opposing edge of the first screen to form a second edge portion. The first and second screens are elastically deformable to permit a user to apply hand pressure to the gutter screen and compress the first and second edge portions toward one another from an uncompressed state in order to provide a force which holds the gutter screen in place over a gutter.

15 Claims, 1 Drawing Sheet

Fig. 1
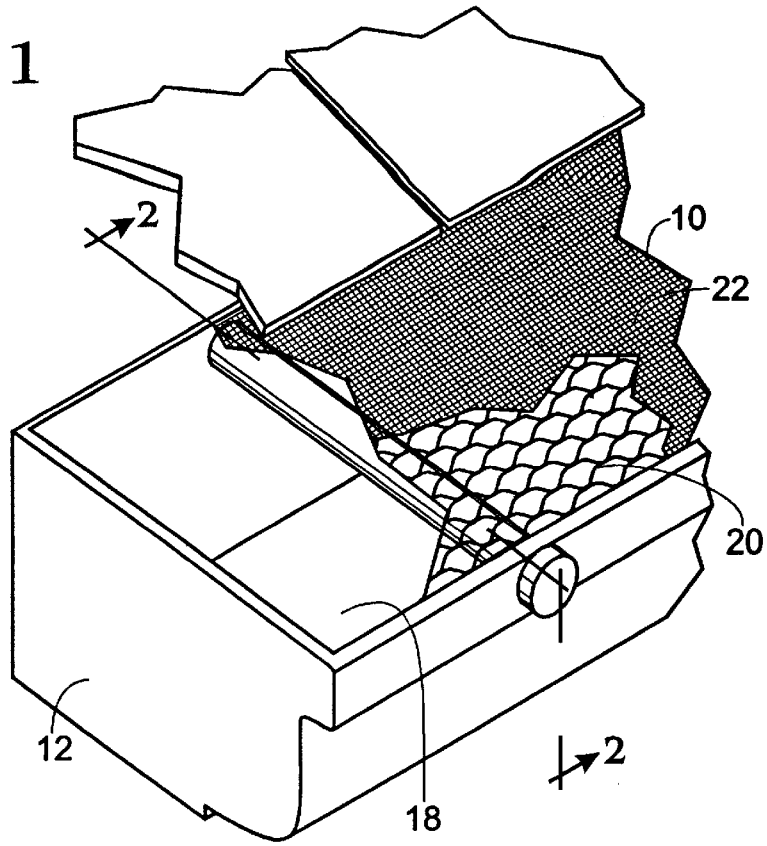
Fig. 4
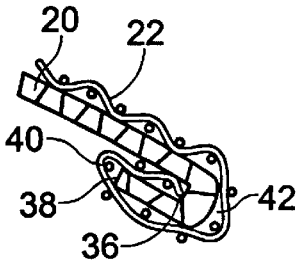
Fig. 3
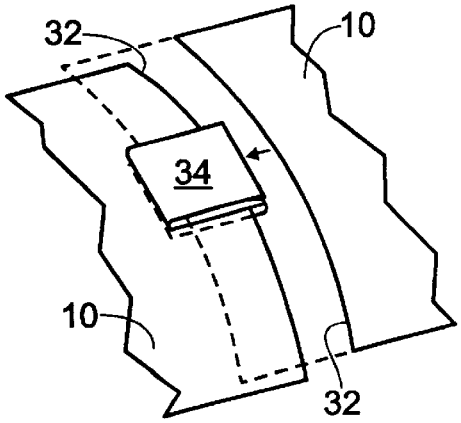
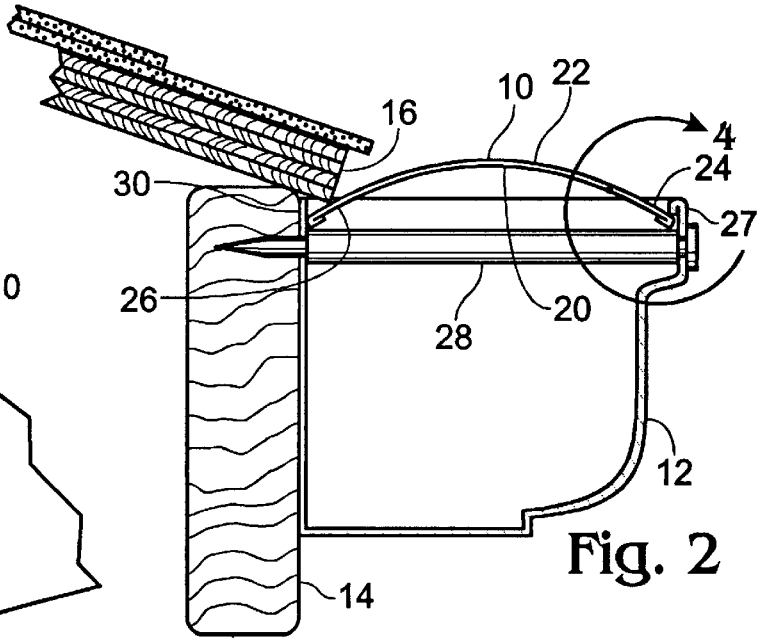
Fig. 2

GUTTER DEBRIS SHIELD

FIELD OF THE INVENTION

The present invention relates to covers and screens for eave gutters. Eave gutter covers are often constructed in elongated sections of a screen-type material which may be placed adjacent the edge of a rooftop to cover a rain gutter. These screens prevent leaves, pine needles and other debris from entering and clogging gutters.

DESCRIPTION OF RELATED ART

The prior art discloses various designs of gutter covers. The general aim of these designs is to allow rain water to pass through the cover and into the gutter drain system while preventing debris from entering and obstructing the drain system.

Many previous designs employ a single screen to pass water and prevent debris from entering the gutter, though there are problems associated with certain single-screen designs. Fine mesh screens are effective at blocking even small debris, but may not be strong enough to withstand forces from wind, accumulated debris or ice and snow. Sturdier screens able to resist these pressures typically have mesh openings which are too large to prevent the passage of fine debris such as pine or fir needles.

U.S. Pat. No. 4,959,932 discloses a rain gutter screen which employs both a small mesh screen and a reinforcing screen, however, this design suffers from a number of problems as well. Fastening the screens together requires a separate rectangular frame which extends around the entire perimeter of the screen layers. This additional part increases the manufacturing cost of the disclosed design. Additionally, installing a cover constructed according to the '932 patent requires that roofing material be removed or lifted to insert an attachment tab which secures the cover in place.

There are other problems in the prior art which are not unique to a particular design. Many designs are unnecessarily costly because they have many components and are expensive to manufacture. Some designs employ a shape which allows blocked debris to accumulate on the gutter cover, increasing strain on the cover and obstructing the flow of rainwater. Some gutter covers are fabricated from heavy materials, making them difficult to handle and install. Other covers are difficult to install because they comprise several parts, or because they require that portions of roofing material be removed or lifted in order to complete installation. Many gutter screens are installed through complicated fastening procedures, often requiring that holes be drilled in the roof, a facia board, or the gutter itself. Still other designs are susceptible to rust and other types of corrosion.

SUMMARY OF THE INVENTION

The present invention provides an improved gutter screen which includes a first screen having mesh openings, top and bottom surfaces, first and second opposing edges, two opposing ends and an elongated axis extending between the opposing ends. Positioned adjacent the first screen is a second screen having mesh openings, top and bottom surfaces, first and second opposing edges and two opposing ends. The first opposing edge of the second screen is fastened to the first opposing edge of the first screen to form a first edge portion and the second opposing edge of the second screen is fastened to the second opposing edge of the first screen to form a second edge portion. The first and second screens are elastically deformable to permit a user to apply hand pressure to the gutter screen and compress the first and second edge portions toward one another from an uncompressed state in order to provide a force which holds the gutter screen in place over a gutter.

BRIEF DESCRIPTION OF THE DRAWINGS

FIG. 1 is a perspective view of an installed gutter screen according to the present invention.

FIG. 2 is an end view of an installed gutter screen according to the present invention.

FIG. 3 depicts a device and method for securing together multiple gutter screens to provide for gutters of varying lengths.

FIG. 4 depicts the preferred method and structure for fastening together the screen layers of the gutter screen.

DETAILED DESCRIPTION OF THE INVENTION

FIGS. 1 and 2 depict a gutter screen 10 constructed according to the present invention and installed on a gutter 12. The gutter may be any one of a variety of sizes, shapes or styles, and is installed adjacent a facia board 14 which is situated below a roof edge 16. The gutter screen covers an opening 18 of gutter 12 and is a multi-layer screen assembly, preferably constructed of a support screen and a filtering screen. In the disclosed embodiment, the support screen is a large mesh expanded metal screen 20, formed of aluminum. Large mesh screen 20 is sturdy enough to retain its shape and withstand ordinary loads resulting from wind, rain, snow and ice, or accumulated debris. In the disclosed embodiment, the filtering screen is a fine mesh fabric screen 22 and has openings which are small enough to block fine debris, such as pine or fir needles. The openings on both screens are large enough to permit water to freely flow through gutter screen 10 and into gutter 12. Fabric screen 22 of the disclosed embodiment is formed of a lightweight, non-corroding aluminum fabric. Alternatively, the support screen may be formed of any material and in any configuration which retains its shape and which is sturdy enough to resist the previously mentioned loads. Likewise, the filtering screen of the present invention may be formed of any material and in any configuration, provided that the filtering screen blocks fine debris while allowing water to freely flow into the gutter.

As depicted in FIGS. 1 and 2, fabric screen 22 of the disclosed embodiment is positioned on top of large mesh screen 20 so that the bottom surface of fabric screen 22 faces the top surface of large mesh screen 20. Both the large mesh screen and the fabric screen have elongated opposing edges. One of the elongated opposing edges of the fabric screen is fastened to the corresponding elongated opposing edge of the large mesh screen to form a first edge portion 24 of gutter screen 10. Similarly, the other elongated opposing edge of the fabric screen is fastened to the other elongated edge of the large mesh screen to form a second edge portion 26. Once installed, edge portions 24 and 26 of gutter screen 10 are generally parallel to roof edge 16.

Although the resulting assembly is durable and retains its shape, the gutter screen is elastically deformable and is easily compressed from its uncompressed rest state by pressure from a user's hands. Preferably, the gutter screen is—in its uncompressed rest state—curved about an axis which is parallel to the edge portions, so that the top surface of the fabric screen is convex and generally semi-cylindrical. Alternatively, a gutter screen constructed according to the present invention may be shaped in any way which facilitates installation and which provides the necessary support against the previously mentioned pressures of wind, rain, snow, etc.

Gutter screen 10 of the disclosed embodiment is installed by compressing the gutter screen to cause first and second edge portions 24 and 26 to be moved closer to one another. In this compressed state, the edge portions exert an outward pressure as gutter screen 10 attempts to return to its uncompressed rest state. The compressed gutter screen is then positioned over the gutter opening and released so that it comes to rest in the installed position depicted in FIGS. 1 and 2. When properly installed, first edge portion 24 rests against an outer lip 27 and at least one support spike 28 of the gutter 12. Second edge portion 26 rests against an inner lip 30 of gutter 12, and is also supported by at least one support spike 28. Alternatively, the second edge portion may rest against a portion of facia board 14, or against roof edge 16. The outward force exerted by edge portions 24 and 26 cause the gutter screen to be held firmly in place over gutter opening 18.

Regardless of the particular cross-sectional shape which is used, gutter screen 10 should—once installed—have at least a partially raised portion between first and second edge portions 24 and 26. In the disclosed embodiment, large mesh screen 20 supports fabric screen 22 so that the top surface of the fabric screen is arcuate with a convex curvature. This design causes wind and water to push any accumulated debris off gutter screen 10 and onto the ground below. A design that does not have a raised portion between the edge portions may allow debris to accumulate and prevent water from freely flowing into the gutter, although such designs are still within the scope of the present invention.

Gutters of varying length may be covered by connecting multiple gutter screens 10 together as depicted in FIG. 3. To achieve this, ends 32 of gutter screens 10 are partially overlapped and secured with an s-clip 34 as shown in the Figure.

FIG. 4 depicts the structure and method used in the disclosed embodiment to fasten fabric screen 22 to large mesh screen 20 at edge portions 24 and 26. A first opposing edge 36 of fabric screen 22 is wrapped and folded around a first opposing edge 38 of large mesh screen 20 to create a first fold 40. First fold 40 is then folded toward the bottom surface of large mesh screen 20 to form a second fold 42. The first fold may also be folded toward the top surface of fabric screen 22 to create the second fold. Alternatively, the screens may be wrapped and folded in any manner which securely fastens them together. After the screens have been folded, a crimping pressure may be applied to secure the folds. The screens may also be secured together by a variety of other means including adhesives, welding, sewing, soldering, staples, pins, use of a separate crimp sleeve, etc.

While the invention has been disclosed in its preferred form, the specific embodiment thereof as disclosed and illustrated herein is not to be considered in a limiting sense as numerous variations are possible and no single feature, function or property of the preferred embodiment is essential. The invention is to be defined only by the scope of the issued claims.

I claim:

1. A gutter screen, comprising:

a first screen having mesh openings, top and bottom surfaces, first and second opposing edges, two opposing ends and an elongated axis extending between the opposing ends; and a second screen having mesh openings, top and bottom surfaces, first and second opposing edges and two opposing ends, the bottom surface of the first screen being positioned adjacent the top surface of the second screen, the first opposing edge of the first screen extending around the first opposing edge of the second screen to grip the bottom surface of the second screen and form a first edge portion, the second opposing edge of the first screen extending around the second opposing edge of the second screen to grip the bottom surface of the second screen and form a second edge portion, and the first and second screens being elastically deformable to permit a user to apply hand pressure to the gutter screen and compress the first and second edge portions toward one another from an uncompressed state in order to provide a force which holds the gutter screen in place over a gutter.

2. The gutter screen according to claim 1, wherein the first opposing edge of the first screen is folded around the first opposing edge of the second screen and the second opposing edge of the first screen is folded around the second opposing edge of the second screen.

3. The gutter screen according to claim 1, wherein the first opposing edge of the first screen is wrapped and folded around the first opposing edge of the second screen and the second opposing edge of the first screen is wrapped and folded around the second opposing edge of the second screen.

4. The gutter screen according to claim 1, wherein each of the first and second edge portions comprise:

a first fold formed by wrapping and folding the first screen around an edge of the second screen to partially cover the bottom surface of the second screen; and a second fold formed by folding the first fold toward one of the surfaces of the second screen.

5. The gutter screen according to claim 1, wherein the first screen is curved about the elongated axis so that the top surface of the first screen is arcuate.

6. The gutter screen according to claim 1, wherein the mesh openings of the second screen are larger than the mesh openings of the first screen.

7. The gutter screen according to claim 1, wherein the first and second screens are aluminum.

8. The gutter screen according to claim 1, wherein the first and second screens are a rustproof material.

9. A method of making a gutter screen, comprising the steps of:

providing a first screen having mesh openings, top and bottom surfaces, first and second opposing edges, two opposing ends and an elongated axis extending between the opposing ends;

providing a second screen having mesh openings, top and bottom surfaces, first and second opposing edges and two opposing ends;

positioning the bottom surface of the first screen adjacent the top surface of the second screen;

forming a first edge portion by extending the first opposing edge of the first screen around the first opposing edge of the second screen so that the first opposing edge of the first screen grips the bottom surface of the second screen; and forming a second edge portion by extending the second opposing edge of the first screen around the second opposing edge of the second screen so that the second opposing edge of the first screen grips the bottom surface of the second screen, wherein the first and second screens are elastically deformable to permit a user to apply hand pressure to the gutter screen and compress the first and second edge portions toward one another from an uncompressed state in order to provide a force which holds the gutter screen in place over a gutter.

10. The method according to claim 9, wherein the step of forming the first edge portion is performed by folding the first opposing edge of the first screen around the first opposing edge of the second screen, and wherein the step of forming the second edge portion is performed by folding the second opposing edge of the first screen around the second opposing edge of the second screen.

11. The method according to claim 9, wherein the step of forming the first edge portion is performed by wrapping and folding the first opposing edge of the first screen around the first opposing edge of the second screen, and wherein the step of forming the second edge portion is performed by wrapping and folding the second opposing edge of the first screen around the second opposing edge of the second screen.

12. The method according to claim 9, wherein each of the forming steps comprises the steps of:

wrapping and folding the first screen around an edge of the second screen to partially cover the bottom surface of the second screen and form a first fold; and folding the first fold toward one of the surfaces of the second screen to form a second fold.

13. The method according to claim 9, further comprising the step of curving the first and second screens about the elongated axis so that the top surface of the first screen is arcuate.

14. The method according to claim 9, wherein the mesh openings of the second screen are larger than the mesh openings of the first screen.

15. A gutter screen, comprising:

a first screen having mesh openings, top and bottom surfaces, first and second opposing edges, two opposing ends and an elongated axis extending between the opposing ends; and a second elongate screen having mesh openings, top and bottom surfaces, and first and second opposing edges formed in the shape of hooks, the bottom surface of the first screen being positioned adjacent the top surface of the second screen, the first opposing edge of the first screen extending around the first opposing edge of the second screen and captured by the hook of the second screen, the second opposing edge of the first screen extending around the second opposing edge of the second screen and captured by the hook of the second screen.

* * * * *